US012378844B2

(12) United States Patent
Chatelet et al.

(10) Patent No.: US 12,378,844 B2
(45) Date of Patent: Aug. 5, 2025

(54) BUILT-UP EVALUATION SHUT-IN TOOL OPERATION CONTROLLED FROM THE SURFACE

(71) Applicant: Schlumberger Technology Corporation, Sugar Land, TX (US)

(72) Inventors: Vincent Chatelet, Clamart (FR); Fabio Cecconi, Clamart (FR); Juan Miguel La Rotta Marin, Sugar Land, TX (US); Luis Silva, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/466,104

(22) Filed: Sep. 13, 2023

(65) Prior Publication Data

US 2024/0392652 A1 Nov. 28, 2024

Related U.S. Application Data

(60) Provisional application No. 63/504,666, filed on May 26, 2023.

(51) Int. Cl.

| | |
|---|---|
| ***E21B 34/16*** | (2006.01) |
| ***E21B 33/127*** | (2006.01) |
| ***E21B 33/134*** | (2006.01) |
| ***E21B 47/06*** | (2012.01) |
| ***E21B 47/07*** | (2012.01) |
| ***E21B 47/12*** | (2012.01) |

(52) U.S. Cl.

CPC ..... *E21B 34/16* (2013.01); *E21B 33/127* (2013.01); *E21B 33/134* (2013.01); *E21B 47/06* (2013.01); *E21B 47/07* (2020.05); *E21B 47/12* (2013.01)

(58) Field of Classification Search

CPC ..... E21B 34/16; E21B 47/07; E21B 33/127; E21B 33/134; E21B 47/06; E21B 47/12

See application file for complete search history.

(56) References Cited

U.S. PATENT DOCUMENTS

| | | | | |
|---|---|---|---|---|
| 9,715,031 | B2 | 7/2017 | Contant et al. | |
| 2001/0050172 | A1* | 12/2001 | Tolman | E21B 43/27 166/305.1 |
| 2005/0236154 | A1* | 10/2005 | Tudor | E21B 33/124 166/308.1 |
| 2011/0168389 | A1 | 7/2011 | Meijs | |
| 2011/0272148 | A1 | 11/2011 | Lovell | |
| 2015/0167403 | A1* | 6/2015 | Sherman | E21B 17/1085 166/380 |
| 2016/0273347 | A1 | 9/2016 | Fipke | |
| 2021/0131277 | A1 | 5/2021 | Giordano et al. | |

OTHER PUBLICATIONS

Combined Search and Exam Report issued in GB Patent Application No. GB2407448.6 dated Nov. 19, 2024, 6 pages.

* cited by examiner

*Primary Examiner* — Dany E Akakpo
(74) *Attorney, Agent, or Firm* — Jeffrey D. Frantz

(57) ABSTRACT

Embodiments presented provide for a built-up, evaluation, shut-in tool that enables real time and pseudo real time control from the surface. In embodiments, an up-link telemetry indicates well data below a configuration valve to the surface. The wellbore data may be used to indicate when true pressure stabilization is achieved during operations.

11 Claims, 4 Drawing Sheets

BUILT-UP EVALUATION SHUT-IN TOOL OPERATION CONTROLLED FROM THE SURFACE

CROSS-REFERENCE TO RELATED APPLICATIONS

The current application claims priority to U.S. Provisional Patent Application 63/504,666 filed on May 26, 2023, the entirety of which is incorporated by reference.

FIELD OF THE DISCLOSURE

Aspects of the disclosure relate to hydrocarbon recovery operations. More specifically, aspects of the disclosure relate to a shut-in tool wherein operations are controlled from the surface.

BACKGROUND

In some instances in hydrocarbon recovery operations, operators use a single strand wire that may lower a package of sensors into a wellbore. The sensors are used to record a variety of wellbore features. These features may be, for example, pressures and temperatures. The commonly known named term for such activities are "slickline" operations.

In some instances, it is necessary to "shut-in" a wellbore. In some instances, a slickline installed valve is used to enable the performance of temporary well shut-in testing. Well shut-in testing consists of rapidly closing a valve to completely interrupt the flow of oil/water/gas to the surface and record the temporal evolution of the pressure and temperature beneath the shut-in valve. This information helps to ascertain, amongst others, the "skin" of the well wherein different data may be used in such analysis. The shut-in procedure calls for cutting off flow within the wellbore; however, pressures and temperatures may be unexpectedly high or low. In further instances, such as near a downhole valve used to shut-in the valve, a rate of pressure build-up occurs. This rate of pressure build up may be problematic for operators. In some embodiments, a specialized tool is used to perform the shut-in test, wherein the tool has a built-in valve. The tool may allow for closing and opening of the tool (and the wellbore) after certain time durations. This opening and closing is programmed at the surface according to a specified schedule. Prior experience from past projects may be used to determine this schedule.

In the tool, one or more memory pressure gauges as well as potential temperature gauges, are suspended below the tool to record readings. The readings are placed in a computer memory for analysis by operators. The tool is lowered via the slickline cable into a desired position in an "open" configuration before a first closure cycle begins. In one or more embodiments, the valve in the tool is designed to close in approximately less than two (2) seconds. In other embodiments, the valve in the tool can be designed to close in less than two seconds, two seconds, three seconds, four seconds, one minute, or other like time periods. During this closure, the well pressure builds. As the desired scheduled time, the tool may then reach an "open" status and the pressure then escapes.

The tool is then recovered with a winch from the surface and recorded pressures and temperatures are evaluated. The conventional method described above has several shortcomings. In one such problem, the tool may be improperly set within the casing/tubing of the wellbore. This leads to motion of the tool causing instability. In further problems, the valve within the tool may incompletely close, leading to a leak, thereby providing an incorrect set of measurements. In some instances, the wellbore can reach an equilibrium pressure much faster than the duration of the valve closure programming, leading to nonproductive time spent by operators in the field waiting for a pressure build-up that has already occurred. Further problems may include rapid depressurization that may damage the valve seals. Such depressurization may also lead to nucleation of gas which may also affect wellbore operations and measurements. Currently, there is no quality control possible from the surface for such operations, other than the initial pre-programming described above.

There is a need to provide an apparatus and methods that are easier to operate than conventional apparatus and methods.

There is a further need to provide apparatus and methods that do not have the drawbacks discussed above, such as tool degradation, incorrect measurements and lost worker field time.

There is a still further need to reduce economic costs associated with operations and apparatus described above with conventional tools by eliminating the waiting period for field operators, thus driving costs down.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are; therefore, not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a method of performing a wellbore operation is disclosed. The method may comprise attaching a cable to a sensor package wherein the cable is installed in a coiled tubing arrangement. The method may further comprise lowering the cable, the sensor package and coiled tubing arrangement to a desired depth within a wellbore. The method may further comprise performing a depth correlation for the cable. The method may further comprise sending a command from an operator at the surface to the cable. The method may further comprise receiving the command from the operator at the surface and setting a plug within the wellbore based on the command. The method may further comprise injecting a gas into the coiled tubing arrangement. The method may further comprise establishing a period of flow within the wellbore based upon, at least in part, the injected gas. The method may further comprise sending a command from the operator at the surface to close a valve controlled by the cable. The method may further comprise monitoring at least one of a temperature and a pressure within the wellbore after the closing of the valve.

In another example embodiment, an arrangement to evaluate shut-in operation is described. The arrangement may comprise a coiled tubing arrangement and an adapter connected to the coiled tubing arrangement at a first end. The arrangement may also comprise a cable connected to the adapter at a second end, wherein the cable is configured one of in the coiled tubing arrangement and outside the coiled tubing arrangement. The arrangement may also be configured wherein the cable comprises a top package connected to the coiled tubing arrangement, and a telemetry cartridge connected to the top package. The cable may also comprise a carrier with a first modem configured to send and receive signals and data and a digital hydraulic setting tool connected to the carrier. The cable may also comprise an expandable plug connected to the setting tool, a built-up evaluation shut-in tool connected to the expandable plug, and a bottom arrangement connected to the shut-in tool, the bottom arrangement configured with valve that may be actuated from a signal.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are; therefore, not be considered limiting of its scope, for the disclosure may admit to other equally effective embodiments.

Figure 1:
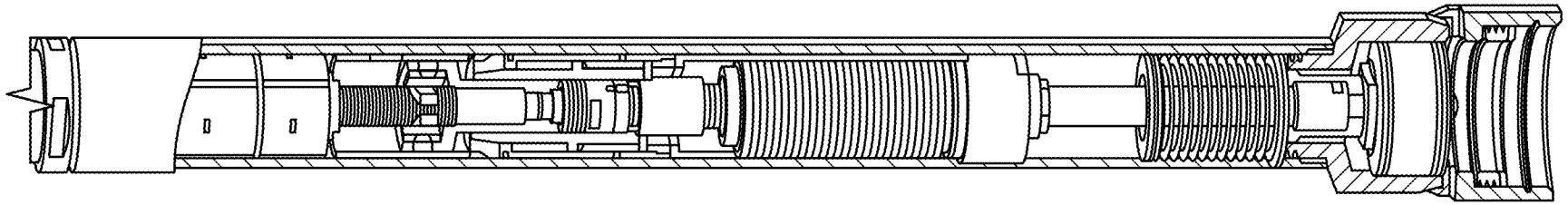
FIG. 1 is a side view of the built-up evaluation shut-in tool.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood; however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

In one example embodiment, a method for operation of a shut-in tool controlled from the surface is disclosed. In this method, the conveyance method is through use of coiled tubing (CT). Deployment of the shut-in tool on the coiled tubing delivers a step change in well testing efficiency by integrating well lifting downhole shut-in, formation pressure buildup, and real time data monitoring on a single run. Aspects of the disclosure provide for use of the systems and methods in highly deviated wells where the deployment of downhole shut-in tools is impractical and cost prohibitive. As will be understood by a person of skill in the art, conventional tools in such deviated holes may also be non-functional.

Figure 2:
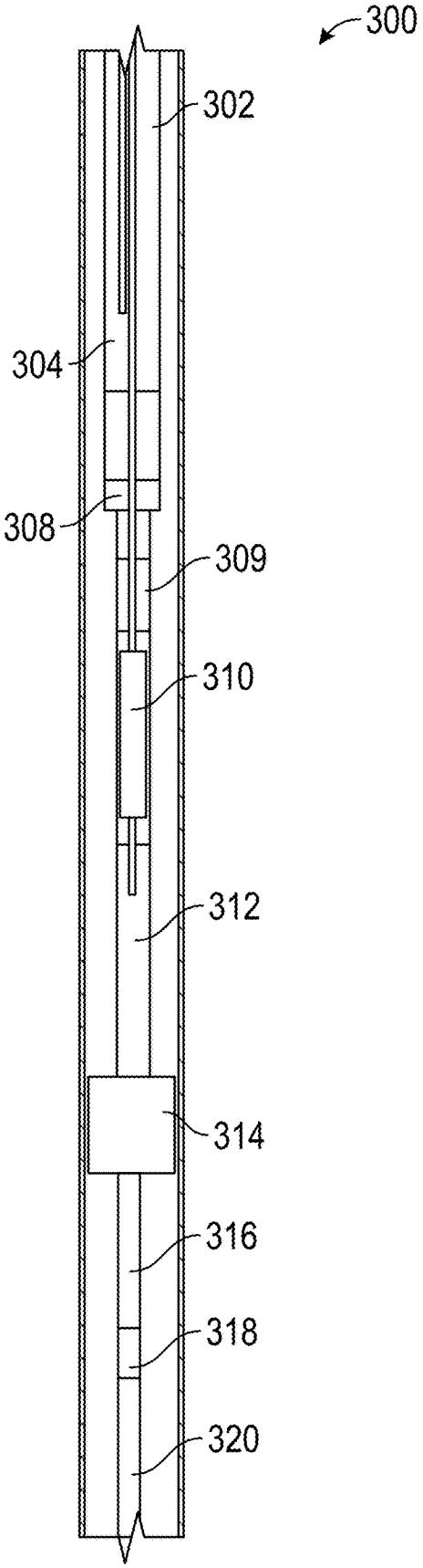
FIG. 2 is a tool-string assembly, according to one or more embodiments.

In one example embodiment, as illustrated in FIG. 2, a cable 300, which can be any cable, such as a coated cable with a solid wire core, is connected with coiled tubing 302. In one embodiment, a top package 304 is provided and is attached to the coiled tubing 302. This top package 304 may include a sensor package as well as battery or batteries for powering electrical components, such as the sensor package within the top package 304. Below the top package 304, an adapter assembly 308 is provided to connect the cable 300 to the coiled tubing 302. Below the adapter assembly 308, a telemetry cartridge 309 is provided at the top of the cable 300. The telemetry cartridge 309 is configured to ascertain positioning of the cable 300 during lowering and raising by the coiled tubing injector head. The cable 300 is installed with the coiled tubing; therefore, the coiled tubing, top package 304, adapter assembly 308, telemetry cartridge 309 are run in hole at the same time, accordingly, there is no need for an independent conveyance of the cable 300. In some embodiments, the arrangements are connected to the coiled tubing at the surface. The cable 300 is installed in the coiled tubing 302 and both are run together as one conveyance. The types of telemetry protocols used by the cartridge 309 may be standard telemetry protocols as known in the art. The cable 300 may further include a carrier 310. The carrier 310 may provide for communication capability between the portions of the cable 300 or other arrangements. To accomplish this, the carrier 310 may be provided with a modem and a battery. The battery is configured to provide electrical energy to the modem for the time of use for the modem within the carrier 310. Below the carrier 310 is a digital hydraulic setting tool 312 and associated battery. The purpose of the digital hydraulic setting tool 312 allows for the cable 300 to be set within the wellbore and prevent movement. The digital hydraulic setting tool 312 prevents movement of the components of the cable 300 and is a significant improvement compared to conventional apparatus as the conventional apparatus (described above) sometimes allows movement, thereby corrupting the measurements taken.

Below the digital hydraulic setting tool 312, a plug 314 is provided for providing a mechanical stop within the wellbore. The plug 314 may be an expandable unit that provides a blockage of the open space within the wellbore. The plug 314 may be rated for temperatures and pressures in excess of anticipated environmental conditions within the wellbore to account for potentially harsh conditions. In embodiments, the plug 314 may be an inflatable packer, in one non-limiting embodiment.

Proceeding further downhole in the arrangements described, a built-up evaluation shut-in tool 316 is provided. The built-up evaluation shut-in tool 316 may be configured with a valve for opening and closing the tool 316 to initiate testing. An accompanying battery may be provided with the tool 316.

Proceeding further, a DMI 318 is provided which in turn is connected to an arrangement 320 which includes a modem, at least one gauge, and battery combination.

Figure 4:
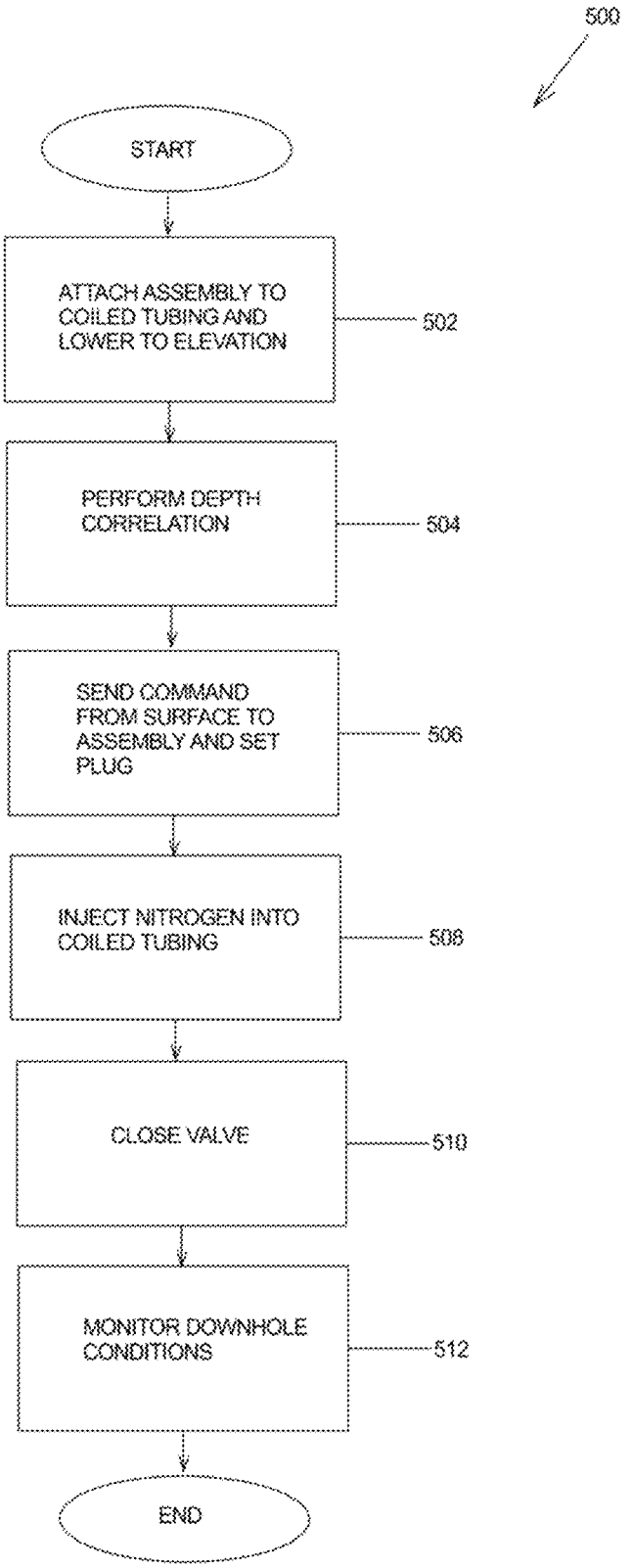
FIG. 4 is an example method in accordance with one example embodiment of the disclosure.

Referring to FIG. 4, a sample method 500 in conformance with one example embodiment of the disclosure is now discussed. The cable 300 is assembled as recited above and is attached to coiled tubing which lowers the cable 300 to a required depth at 502. Once the assembly has reached the target depth, a depth correlation may be performed at 504. In embodiments, the depth correlation may be performed using gamma-ray technology and/or sensors embedded inside the cable 300. Communications between the sensors and an up-hole environment may be achieved through use of a connected optical line.

Figure 3:
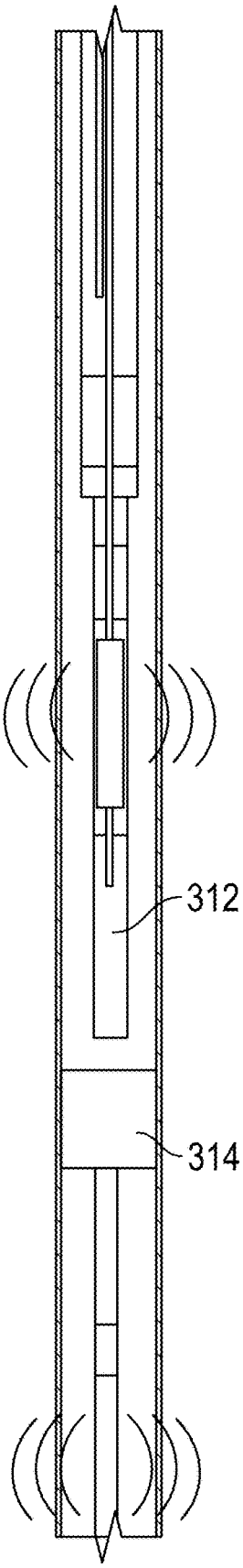
FIG. 3 is a second view of the tool-string in a separated position occurring at the plug.

At 506, the method continues where a command is sent from the up-hole environment to the cable 300. This command is used to set the plug 314 and secure the cable 300. The setting of the plug 314 may be monitored from the surface. At the end of the setting, a pin is sheared and the digital electrohydraulic setting tool 312 is disconnected from the plug per FIG. 3.

At 508, the method continues where nitrogen is injected into the coiled tubing in order to lift the production. During injection of the nitrogen, the pressure and temperature are monitored and data is transmitted by the arrangement 320 to the up-hole modem at 310. The up-hole modem at 310 may then transmit the data to the up-hole environment.

After a period of flow, at 510, an operator at the surface sends a command to the up-hole modem at 310, which then transfers the command to the arrangement 320 to close the valve within the built-up evaluation shut-in tool 316. Measurements of the downhole conditions are then monitored, at 512. The pressure/temperature data is received and analyzed in real time in one embodiment. In other embodiments, the data may be analyzed at other times. The analysis can occur at the wellsite or data may be transmitted and analyzed at an offsite location.

Based on the data analysis, different decisions may be undertaken. The survey may continue if there is no leak at the valve so that pressure may stabilize. In the case of a leak, operations may stop further actions and the apparatus may be removed from the wellbore. In some embodiments, the valve in the built-up evaluation shut-in tool 316 may be activated from an up-hole command at the end of the survey via telemetry. In other embodiments, another survey may be undertaken, with a closing of the valve within the tool 316.

Due to the arrangement and methods described above, operators have full access to downhole data as well as control of downhole activities, unlike conventional apparatus and methods. Operations are performed in one wellbore insertion, minimizing the costs of such analysis. Operators, through use of the downhole data, do not have to excessively wait inordinate amounts of time to complete actions.

Operations to retrieve the cable 300 may be performed wherein the coiled tubing with the cable 300 is withdrawn from the wellbore. A separate removal operation may be conducted to remove the built-up evaluation shut-in tool 316 as well as the plug 314.

Variants for the operations discussed above are possible. In some embodiments, the tool string assembly and telemetry can be replaced by wireline or an active system. Telemetry systems disclosed above may be replaced by electromagnetic short-hop telemetry systems. As will be understood, in embodiments, different types of shut-in tools may be used.

Example embodiments of methods and apparatus appearing in the claims are described. Such methods and apparatus should not be considered limiting. In one example embodiment, a method of performing a wellbore operation is disclosed. The method may comprise attaching a cable to a sensor package wherein the cable is installed in a coiled tubing arrangement. The method may further comprise lowering the cable, the sensor package and coiled tubing arrangement to a desired depth within a wellbore. The method may further comprise performing a depth correlation for the cable. The method may further comprise sending a command from an operator at the surface to the cable. The method may further comprise receiving the command from the operator at the surface and setting a plug within the wellbore based on the command. The method may further comprise injecting a gas into the coiled tubing arrangement. The method may further comprise establishing a period of flow within the wellbore based upon, at least in part, the injected gas. The method may further comprise sending a command from the operator at the surface to close a valve controlled by the cable. The method may further comprise monitoring at least one of a temperature and a pressure within the wellbore after the closing of the valve.

In another example embodiment of the disclosure, the method may be performed wherein the depth correlation is performed using gamma-ray technology.

In another example embodiment of the disclosure, the method may be performed wherein the depth correlation is performed using sensors with the coated cable with a solid wire core.

In another example embodiment of the disclosure, the method may be performed wherein the depth correlation is performed through an optical line connecting a surface operator to the coated cable with a solid wire core.

In another example embodiment of the disclosure, the method may be performed wherein the gas is nitrogen.

In another example embodiment of the disclosure, the method may further comprise opening the valve allowing pressure to equalize within the wellbore; and retrieving at least a part of the coated cable with a solid wire core attached to the coiled tubing.

In another example embodiment of the disclosure, the method may be performed wherein the monitoring the at least one of the temperature and the pressure within the wellbore after the closing of the valve includes recording at least one of the temperature and the pressure within the wellbore.

In another example embodiment of the disclosure, the method may further comprise analyzing the at least one of the temperature and the pressure.

In another example embodiment of the disclosure, the method may be performed wherein the analyzing is performed at the wellsite.

In another example embodiment, an arrangement to evaluate shut-in operation is described. The arrangement may comprise a coiled tubing arrangement and an adapter connected to the coiled tubing arrangement at a first end. The arrangement may also comprise a cable connected to the adapter at a second end, wherein the cable is configured one of in the coiled tubing arrangement and outside the coiled tubing arrangement. The arrangement may also be configured wherein the cable comprises a top package connected to the coiled tubing arrangement, and a telemetry cartridge connected to the top package. The cable may also comprise a carrier with a first modem configured to send and receive signals and data and a digital hydraulic setting tool connected to the carrier. The cable may also comprise an expandable plug connected to the setting tool, a built-up evaluation shut-in tool connected to the expandable plug, and a bottom arrangement connected to the shut-in tool, the bottom arrangement configured with valve that may be actuated from a signal.

In another example embodiment, the arrangement may be configured wherein the top package includes at least one of a sensor package and a battery.

In another example embodiment, the arrangement may be configured wherein the telemetry cartridge is configured to ascertain a positioning of the assembly.

In another example embodiment, the arrangement may be configured wherein the expandable plug is an inflatable packer.

In another example embodiment, the arrangement may be configured wherein the inflatable packer may be deflated upon a command from an operator.

In another example embodiment, the arrangement may be configured wherein the valve has two positions.

In another example embodiment, the arrangement may be configured wherein the two positions are open and closed.

In another example embodiment, the arrangement may be further configured with a solenoid connected to the valve, the solenoid configured to actuate the valve.

In another example embodiment, the arrangement may be configured wherein the telemetry cartridge is configured to ascertain a position within the wellbore.

In another example embodiment, the arrangement may be configured wherein the top package comprises at least one sensor package.

In another example embodiment, the arrangement may be configured wherein the top package further comprises at least one battery.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. An arrangement to evaluate shut-in operations, comprising:

a coiled tubing arrangement;

an adapter connected to the coiled tubing arrangement at a first end;

a cable connected to the adapter at a second end, wherein the cable is installed in the coiled tubing arrangement, the cable comprising:

a top package connected to the coiled tubing arrangement;

a telemetry cartridge connected to the top package;

a carrier with a first modem configured to send and receive signals and data;

a digital hydraulic setting tool connected to the carrier;

an expandable plug connected to the setting tool;

a built-up evaluation shut-in tool connected to the expandable plug; and a bottom arrangement connected to the shut-in tool, the bottom arrangement configured with valve that may be actuated from a signal.

2. The arrangement according to claim 1, wherein the top package includes at least one of a sensor package and a battery.

3. The arrangement according to claim 1, wherein the telemetry cartridge is configured to ascertain a positioning of an assembly including the cable, the top package and the coiled tubing arrangement.

4. The arrangement according to claim 1, wherein the expandable plug is an inflatable packer.

5. The arrangement according to claim 4, wherein the inflatable packer may be deflated upon a command from an operator.

6. The arrangement according to claim 1, wherein the valve has two positions.

7. The arrangement according to claim 6, wherein the two positions are open and closed.

8. The arrangement according to claim 1, further comprising: a solenoid connected to the valve, the solenoid configured to actuate the valve.

9. The arrangement according to claim 1, wherein the telemetry cartridge is configured to ascertain a position within a wellbore.

10. The arrangement according to claim 1, wherein the top package comprises: at least one sensor package and at least one battery.

11. The arrangement according to claim 1, wherein the cable is a coated cable with a solid wire core.

* * * * *